United States Patent [19]

Fleissner

[11] Patent Number: 5,006,183

[45] Date of Patent: Apr. 9, 1991

[54] PROCESS FOR PRODUCING NONWOVEN FABRICS WITH STEAM PRETREATMENT OF BINDER POWDER

[75] Inventor: Gerold Fleissner, Chur, Switzerland

[73] Assignee: Fleissner Maschinenfabrik AG, Rebstein, Switzerland

[21] Appl. No.: 408,730

[22] Filed: Sep. 18, 1989

[30] Foreign Application Priority Data

Sep. 16, 1988 [DE] Fed. Rep. of Germany ..... 3831496

[51] Int. Cl.[5] ..... B27N 1/00

[52] U.S. Cl. ..... 156/62.2; 156/62.6; 156/296; 156/322; 156/324; 264/119; 264/122

[58] Field of Search ..... 156/62.6, 62.2, 296, 156/322, 324; 65/4.4; 264/119, 518, 122, 345; 68/5 D

[56] References Cited

U.S. PATENT DOCUMENTS 3,619,322 11/1971 Fleissner ..... 156/62.2 X
3,770,374 11/1973 Fleissner ..... 68/5 D X
3,865,661 2/1975 Hata et al. ..... 156/180 X
3,989,788 11/1976 Estes, Jr. et al. ..... 156/62.2 X
4,363,680 12/1982 Buck, Jr. et al. ..... 156/62.2 X
4,906,309 3/1990 Bichot et al. ..... 156/62.6

*Primary Examiner*—Michael W. Ball
*Assistant Examiner*—Jeff H. Aftergut
*Attorney, Agent, or Firm*—Antonelli, Terry, Stout & Kraus

[57] ABSTRACT

Nonwoven fabrics are produced by mixing fibers especially textile fibers with binder powders, and by bonding the fibers and binder powders in twin-platform belt ovens for heating the powder. During this step, air is passed through the nonwoven mat or web or interlocked fibers. In order to avoid contamination of the oven with binder powder fragments detached from the nonwoven fabric, the provision is made to arrange a steaming process upstream of the air heat treatment process. The steam is to condense on the fibers or on the binder powder and to promote sticking of the powder to the fibers of the nonwoven fabric. Advantageously, a sieve drum device is employed in place of the twin-platform belt oven for the final bonding heat treatment; this device can operate herein in a much more economical fashion than the oven.

9 Claims, 1 Drawing Sheet

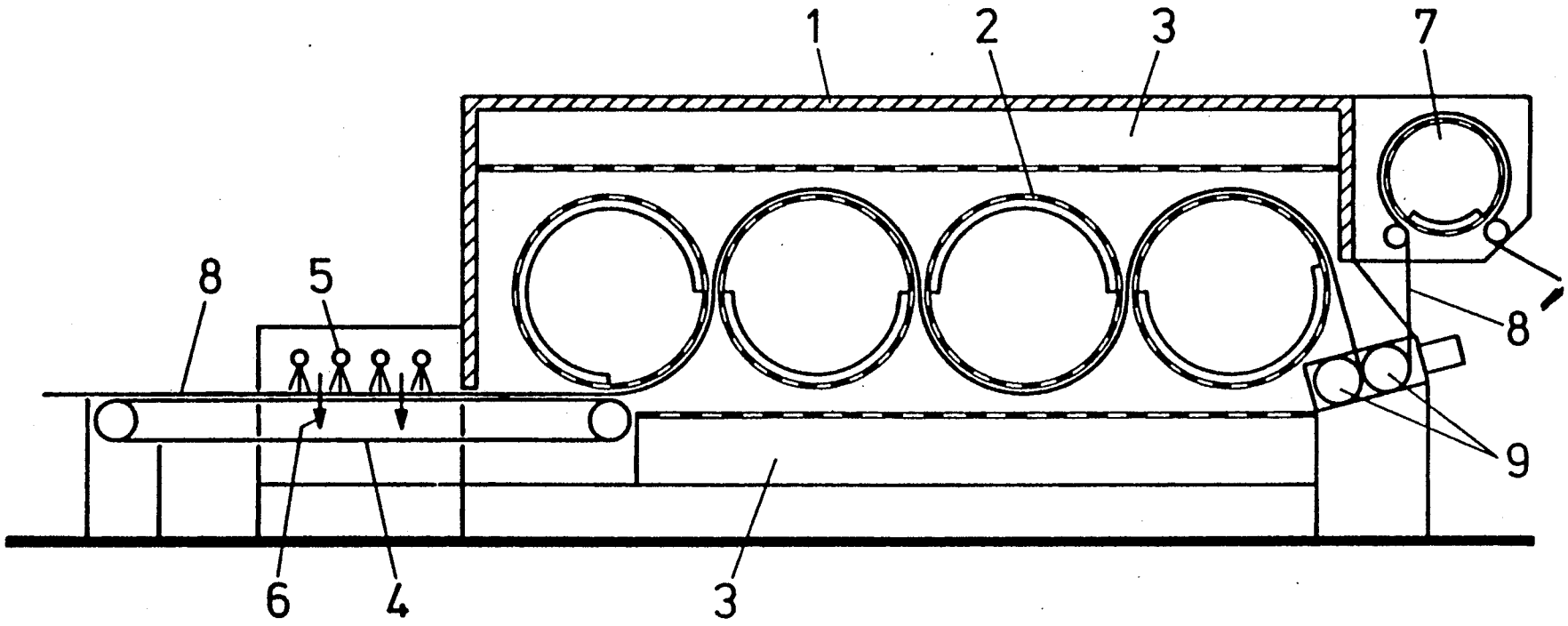
1
2
3
3
4
5
6
7
8
8
9

PROCESS FOR PRODUCING NONWOVEN FABRICS WITH STEAM PRETREATMENT OF BINDER POWDER

BACKGROUND OF THE INVENTION

The invention relates to a process for the thermal bonding of fibers to produce nonwoven fabrics with bonding or binder powder wherein the nonwoven fabric is produced from textile fibers including reclaimed wool, cotton, or spun rayon, or from synthetic fibers, such as acrylic, glass, or other mineral fibers and the fibers are uniformly mixed, during, for example, aerodynamic formation of a nonwoven mat or web, with binder powder of a phenolic resin or novolak, and wherein heated air is passed through the nonwoven mat or web for bonding purposes.

Fibrous mats of this type are essentially manufactured as blown fleeces by the aerodynamic method and are mixed during this production with bonding powders so that the latter are uniformly distributed in the resulting nonwoven fabric. For the bonding of mats or fleeces, so-called twin-belt ovens are utilized wherein the nonwoven mats or fleeces are held between two plate-shaped belts and are subjected to hot air or, respectively, are slightly ventilated. The problem in this bonding process resides in that the binder powder sticks to the platform belts and thus contaminates these belts. The binder powder is baked into the plates in the long run and it then becomes difficult to clean the dirt off the plates. The second problem resides in that the binder powder distributed in the nonwoven fabric is partially entrained by the air, even if the throughflow of air is merely slight, and is then blown about in the entire oven by turbulence. It is readily evident that in such a case the binder powder will settle on the walls and thus, in the course of time, will clog the entire oven with its stickiness. Furthermore, the binder particles entrained by the air are, of course, taken away from the nonwoven fabric so that the binder concentration remaining in the nonwoven fabric cannot be accurately defined. The proportion of binder powder, however, is essential for the properties of the nonwoven fabric to be obtained. Consequently, the properties of the nonwoven fabrics can be only conditionally predetermined.

In the previously known manufacturing method, gases are generated in the oven by the combustion of the binder components; these gases are toxic and therefore, also for this reason, must not be permitted to enter into the operator's cubicle. It is thus necessary to operate the platform conveyor oven with a great amount of waste air so that fresh air is taken in at the inlet and outlet and, consequently, no vapors escape therefrom. On account of this high quantity of waste air, the energy balance of the oven is, however, considerably impaired since the ovens normally are operated at a circulating air temperature of 200° C., and thus the waste air likewise has this temperature. Since the phenolic resin vapors, however, are deleterious to health, the waste air must be passed through an after-burning unit. The after-burning unit normally operates at temperatures of 800°-900° C. It is readily apparent that the energy consumption in the conventional bonding method in the afterburning unit is even higher than the energy consumption in the oven for bonding the products.

Additionally, these twin-plate belt ovens work with a poor degree of efficiency since the two metallic plate belts carry a very large amount of energy to the outside.

This is due to the fact that at least the lower platform belt must be additionally passed through a subsequent cooling zone for the nonwoven fabric. Thus, with each revolution, the belts must again be reheated.

SUMMARY OF THE INVENTION

The invention is based on the object of finding a treatment method avoiding the above-enumerated drawbacks. A very essential aspect herein is to obtain the result that the powdered binder, uniformly mixed within the fibers during production of the nonwoven fabric also remains in the nonwoven fabric in the original concentration. It is likewise essential that less energy be utilized during bonding in the process. It has been found, in particular, that there is not any increases in losses of wasted energy, which were heretofore unavoidable due to the extensive use of the after-burning unit.

Starting with the method of the type described hereinabove, the invention resides in that a steam treatment is arranged upstream of the hot-air process for binding of the fibers making up the nonwoven fabric. This steam treatment is, at first glance, illogical for the bonding of the nonwoven fibers under elevated temperature since as a necessity the steam must settle as a condensate on the materials and then the condensate must be additionally removed by drying. However, as has been discovered, this steam treatment achieves the objective that the binder powder is wetted by the steam—i.e. the condensate—and then this powder will adhere more tenaciously to the fibers making up the nonwoven fabric. Consequently, the binder components are not entrained by the air flow during steam through-flow and, respectively, during the subsequent step of passing hot air through the web and resulting fabric. The binder components are not removed from the nonwoven fabric and thus cannot be deposited, either, on the conveying means of the oven, no matter what type.

The steam to be used for treating the nonwoven mat, web or fleece at the beginning of the treatment procedure can either be sprayed from one side or also from both sides onto the nonwoven material, or the steam can also be passed transversely through the nonwoven material. It is likewise possible, in succession or simultaneously, to heat up one side of the nonwoven material with infrared radiators or thus to heat-seal same, and to expose the other side to steam. Thereafter, the nonwoven material preferably should be transported through a sieve drum facility wherein gas heated up to the treatment temperature is sucked through the nonwoven material. Suitably, the sieve drum facility consists of at least two sieve drum devices so that the nonwoven material, after the steam treatment, is transported alternatingly on both sides and thus is subjected to alternating throughflow.

Approximately 20 years ago, a sieve drum dryer was utilized for the production of nonwoven fabrics with phenolic resin as the binder. However, use of the dryer failed after a short time inasmuch as the drum was very highly contaminated with phenolic resin and too much of the binder powder entered the circulating air. Normally, sieve drum dryers are operated with substantially higher suction throughflow velocities and thus circulating air rates than is the case with the aforementioned plate-type belt dryers. Experiments have now revealed that there is no longer any contamination of the surfaces of the sieve drums after the steam treatment of the present invention. Consequently, the more economical sieve drum can be employed in the bonding of nonwoven fibers mixed with the powdered binders. The increase in economy not only resides in that it is possible to operate, with a sieve drum dryer, at throughflow rates of around 2 m/sec; whereas with a plate belt dryer, according to the process used heretofore, less than one-fourth of this air rate is utilized, but also in that the sieve drum dryer includes the advantage that the treatment drums when discharging the nonwoven fabric remain in the hot atmosphere and, therefore, are not cooled off with each revolution.

The apparatus for performing the hot-air drying is known per se. It consists of a sieve drum unit wherein a plurality of sieve drums rotating in the treatment chamber are each provided with a fan at their end faces; this fan sucks the treatment air through each sieve drum and thus through the nonwoven web transported on the drums. Upstream of such a sieve drum unit, a device is to be arranged wherein the nonwoven web containing binder powders can be exposed to steam on one side or both sides. In this connection, it is expedient to also pass the steam through the nonwoven web with slight suction so that the binder powder is completely wetted by this steam treatment transversely through the nonwoven web and consequently this binder powder will also adhere to the fibers transversely through the nonwoven web.

BRIEF DESCRIPTION OF THE DRAWINGS

The sole FIGURE of the drawing shows, by way of example, one embodiment of an apparatus usable for bonding fibers with powdered bonding medium to form nonwoven fabrics.

The apparatus consists of a sieve drum dryer 1 which, in this example, is made up of four series-arranged sieve drums 2, the nonwoven web 8 is arranged to extend around the drums in a meander-shaped fashion. The hot treatment air at 200° to 220° C. is taken in from the interior of the sieve drum 2 at the end face of each sieve drum by a fan, not shown, and is conducted via pressure chambers 3 arranged above and below the row of sieve drums back again to the treatment chamber in which the sieve drum are located.

Upstream of the sieve drum unit 1, an inlet endless conveyor belt 4 is illustrated which, in this embodiment, transfers the nonwoven web 8 tangentially to the bottom of the first sieve drum 2. The nonwoven web of textile fiber admixed with binder powder, e.g. a phenolic resin binder is transported on the topside of the endless belt 4 and is exposed from the top to steam (at 95° to 100° C.) discharged from spray nozzles 5, the steam being blown not only onto the surface of the textile material but also being sucked through the nonwoven web 8 in correspondence with arrows 6, by a reduced pressure chamber located under the web. After the steaming step in the illustrated steaming box and the subsequent hot-air treatment performed on the sieve drums, the hot nonwoven fabric 8' is compressed on the calender 9 to the appropriate thickness and is cooled on the sieve drum 7 wherein ambient air is drawn through the fabric.

What is claimed is:

1. A process for thermal bonding of a web of fibers with binder powder wherein the fibers comprised of reclaimed wool, cotton, spun rayon, synthetic polymer, or glass fibers are uniformly mixed with binder powder comprising a phenolic resin or novolak resin to form a binder-containing nonwoven web; the nonwoven web containing the binder powders is passed through a steam treatment zone wherein steam is drawn through the nonwoven to wet the binder powders with steam condensate so that the binder powders will adhere more tenaciously to the fibers; and heated air is passed through the binder-containing nonwoven web for bonding of the fibers with said binder powder in a heat treatment zone by passing the binder-containing nonwoven web successively over a plurality of sieve drums, said binder powder remaining within the nonwoven web without adhering to surfaces of the sieve drums.

2. A process according to claim 1, wherein the steam is sprayed onto the binder-containing, nonwoven web.

3. A process according to claim 2, wherein steam is sprayed onto the binder-containing, nonwoven web from both sides.

4. A process according to claim 1, wherein steam is conducted transversely through the binder-containing, nonwoven web.

5. A process according to claim 1, wherein in succession one side of the binder-containing nonwoven web is heated up by infrared radiators and the other side is exposed to the steam.

6. A process according to claim 1, wherein simultaneously one side of the binder-containing nonwoven web is heated up by infrared radiators and the other side is exposed to steam.

7. A process according to claim 1, wherein the nonwoven web containing the binder powders, after the steam treatment, is transported alternatively on both sides of the plurality of sieve drums and, during this transportation, the web is subjected to alternating throughflow of heated dry air.

8. A process for producing a nonwoven fabric which comprises conveying a nonwoven web of textile fibers containing binders powders of a resinous material through a steam treatment zone; applying steam to at least one side of the web to wet the binder powders with condensed steam so that the binder powders will tenaciously adhere to the textile fibers making up a nonwoven fabric; and then conveying a resulting pre-bonded preheated binder-containing nonwoven web over perforated surfaces of a plurality of rotating sieve drums to effect throughflow of heated dry air alternately through the web and to effect further bonding of the fibers with the binder powder and to form a nonwoven fabric; said binder powders remaining within the resulting nonwoven fabric without adhering to the perforated surfaces of said plurality of rotating sieve drums.

9. A process according to claim 8, wherein the nonwoven web of textile fibers containing the binder powders is initially conveyed on an endless conveyor belt and a top side of the nonwoven web is sprayed with steam and the steam is also drawn through the web of nonwoven fibers by a reduced pressure chamber located under the web.

* * * * *